United States Patent [19]

Derkatz

[11] Patent Number: 5,009,348

[45] Date of Patent: Apr. 23, 1991

[54] KNIFE SHEATH OF TOUGH FLEXIBLE MATERIAL

[76] Inventor: Keith Derkatz, P.O. Box 1118, Stn. "A", Kelowna, B.C., Canada, V1Y 7P8

[21] Appl. No.: 462,802

[22] Filed: Jan. 10, 1990

[51] Int. Cl.[5] ..... B26B 29/02

[52] U.S. Cl. ..... 224/232; 224/240; 224/253

[58] Field of Search ..... 224/232, 253, 240, 224, 224/226, 228, 991

[56] References Cited

U.S. PATENT DOCUMENTS

| | | | |
|---|---|---|---|
| 127,104 | 5/1872 | Rice | 224/232 |
| 1,898,171 | 2/1933 | Bunnell | 224/253 |
| 3,731,858 | 5/1973 | Baker | 224/911 |
| 4,253,593 | 3/1981 | Pattermann | 224/232 |
| 4,759,483 | 7/1988 | Willoughby | 224/232 |

FOREIGN PATENT DOCUMENTS

| | | | |
|---|---|---|---|
| 1208702 | 2/1960 | France | 224/232 |
| 2063647 | 6/1981 | United Kingdom | 224/224 |

*Primary Examiner*—Linda J. Sholl

*Attorney, Agent, or Firm*—Eckert, Seamans, Cherin & Mellott

[57] ABSTRACT

A knife sheath of tough flexible material, comprises a back wall, a front wall attached at its periphery to said back wall to form a knife-receiving pouch, and a pair of laterally spaced slits in said front wall for receiving a wearer's belt, said slits being offset in the longitudinal direction, whereby when the wearer's belt is passed through said offset slits said pouch sits at a forward angle on the wearer's belt and snugly located on the wearer's hip and tucked in the belt.

6 Claims, 2 Drawing Sheets

KNIFE SHEATH OF TOUGH FLEXIBLE MATERIAL

This invention relates a knife sheath of tough flexible material, such as leather.

BACKGROUND OF THE INVENTION

Sportsmen often have a need to carrying a sporting knife, either of the fixed blade or folding blade type, and for this purpose it is convenient to carry the knife in some kind of sheath, from which it is quickly accessible. Conventional sheaths have a pair of parallel slits in the back wall of a pouch for the knife through which a belt can be passed. Such sheaths suffer from the disadvantage that they tend to ride along the belt into an awkward an uncomfortable position and generally flop around, and furthermore the angle of the sheath is such that the knife cannot be conveniently and comfortably accessed, the user often having to put his arm into an awkward position to remove the knife. Some sportsman have adopted the habit of tucking the knife into their belt, but such a practice is dangerous for a fixed-blade knife, and inconvenient because the knife will often fall out.

An object of the invention is to provide a knife sheath which alleviates the aforementioned disadvantages of the prior art.

SUMMARY OF INVENTION

According to the present invention there is provided a knife sheath of tough flexible material, comprising a back wall, a front wall attached at its periphery to said back wall to form a knife-receiving pouch, and a pair of laterally spaced front wall for receiving a wearer's belt, said slits being offset in the longitudinal direction, whereby when the wearer's belt is passed through said offset slits said pouch sits at a forward angle on the wearer's belt and snugly located on the wearer's hip and tucked in the belt. The offset slits in the front wall of the pouch ensure that the pouch sits snugly within the wearer's belt at a convenient angle for comfortable and rapid access.

The pouch is preferably closed a flap folded over from the back wall and secured by a press-stud fastener. The entire sheath can be made of tough leather or other suitable synthetic material.

BRIEF DESCRIPTION OF DRAWINGS

The invention will now be described in more detail, by way of example only, with reference to the accompanying drawings in which.

DESCRIPTION OF PREFERRED EMBODIMENTS

Figure 1:
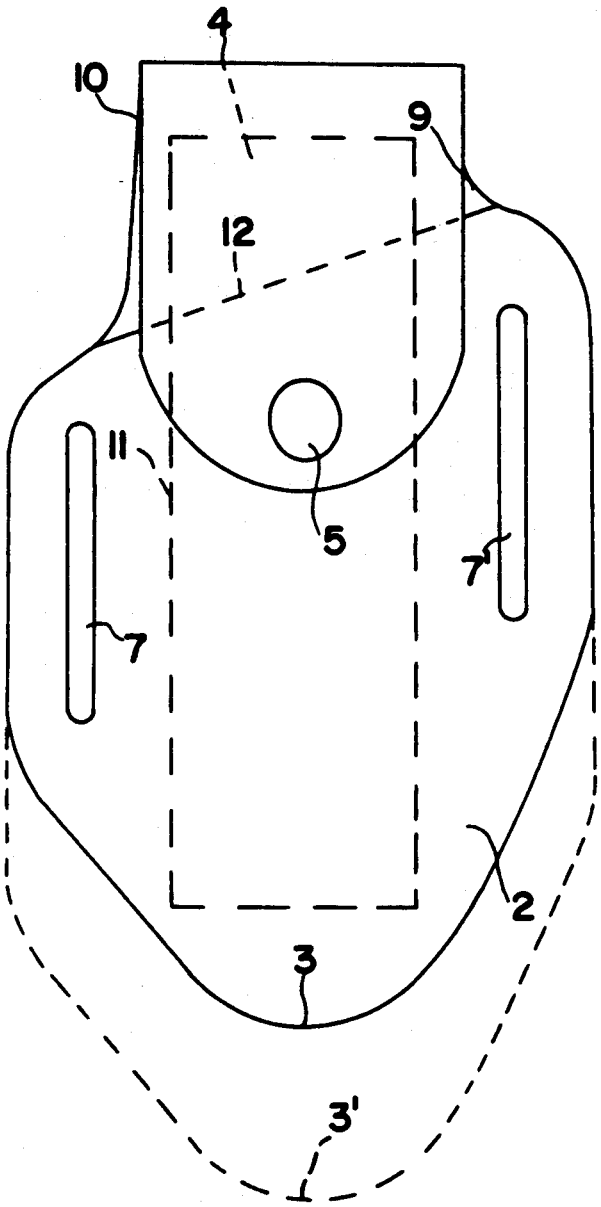
FIG. 1 is a plan view of a knife sheath according to one embodiment of the invention.
Figure 2:
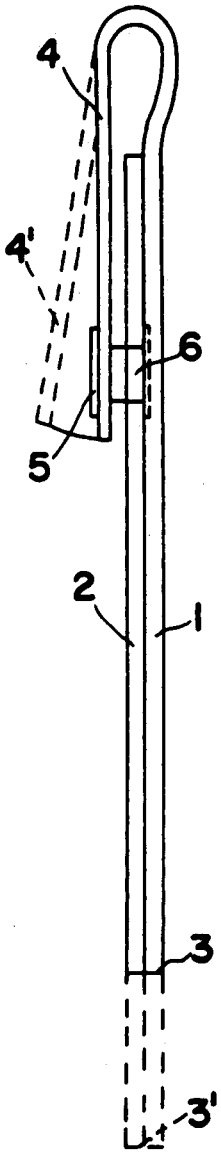
FIG. 2 is a side view of the knife sheath shown in FIG. 1.

The knife sheath shown in the drawings is made of tough leather and comprises a back wall 1 and front wall 2, each having straight parallel sides tapering at a lower portion to a smoothly curved convex apex 3 at the bottom. The sides and bottom are stitched together along their periphery by tough stitching (not shown) so that the front and back walls form a knife-receiving pouch, which contains a folding hunting knife 11, shown in dotted outline.

The back wall 1 and front wall 2 have a shoulder 9. In the case of the back wall this merges into a neck portion 10, which extends into a flap 4 folded over the top of the front wall 2 to provide a closure for the pouch and retain the knife 11 safely therein. The front wall 2 has a straight top edge 12 angled at the same angle as the offset of the slits, so that when the sheath is located on the belt with the belt passing through the slits 7,7' the top edge 12 is approximately horizontal.

A press-stud fastener 5 co-operates with a corresponding stud 6 inserted in the front wall to securely hold the closure flap 4 in the closed position.

The front wall 2 has a pair of laterally spaced belt-receiving slits 7,7', which are offset in the longitudinal direction. In use the wearer passes his belt through the slits so that the knife sheath is securely located thereon.

Figure 3:
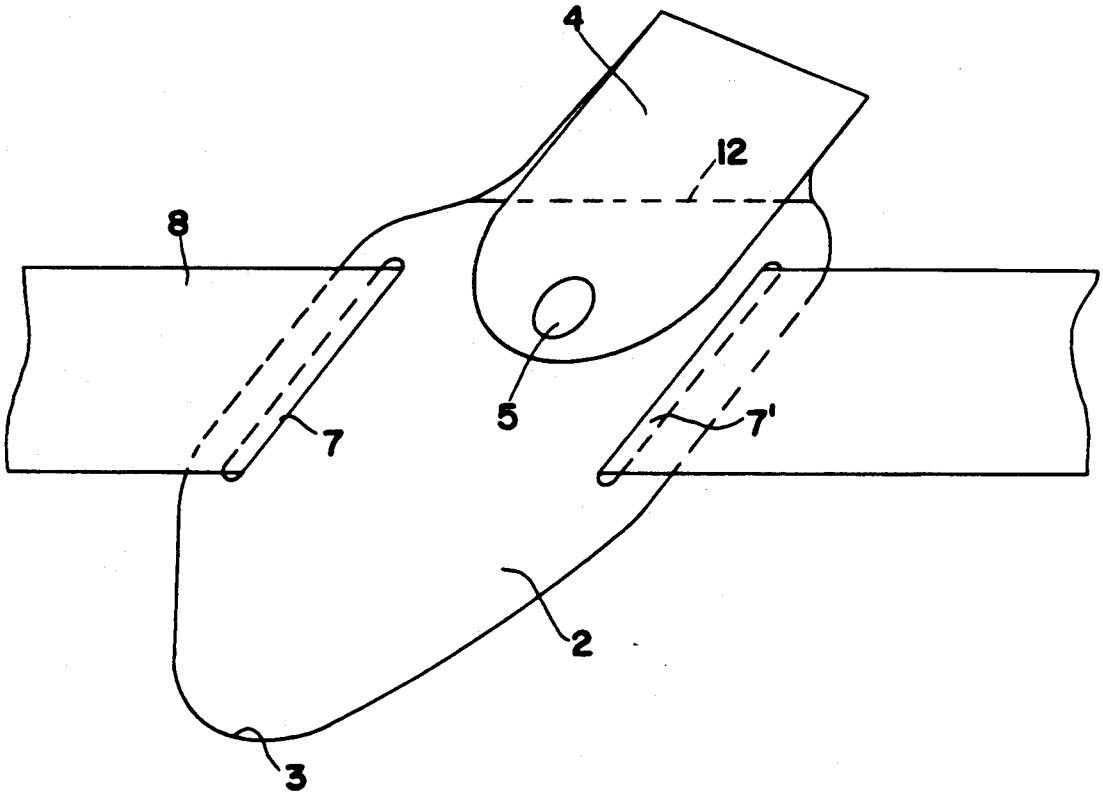
FIG. 3 is a view of the knife sheath located on a belt.

As shown in FIG. 3, when the knife sheath is placed on the belt 8, due to the longitudinal offset in the slits it sits at a forwardly facing angle, giving the wearer convenient access to opening flap 4 and knife 11 contained within the pouch. The fact that the belt passes through the front wall 2 of the belt causes the sheath to be tucked in the belt securely located on the wearer's hip in a comfortable location. The sheath has a comfortable feel similar to that experienced by sportsmen who tuck the knife directly into their belt, but without the attendant disadvantages and dangers of this practice.

The sheath can be made in different sizes, and as shown in dotted outline at 3', the whole pouch can be made deeper for longer knives.

The knife sheath can be made without a closure flap for fixed blade hunting knives.

The sheath can be made of ballistic nylon, Kevlar TM, or molded leather.

I claim:

1. A knife sheath of tough flexible material, comprising a back wall, a front wall attached at its periphery to said back wall to form a knife-receiving pouch, and a pair of laterally spaced slits in said front wall of said knife-receiving pouch for receiving a wearer's belt that passes through said pouch between the front and back walls thereof, said slits being offset in the longitudinal direction, whereby when the wearer's belt is passed through said offset slits, said pouch sits at a forward angle on the wearer's belt, snugly located on the wearer's hip and tucked in the belt.

2. A knife sheath as claimed in claim 1, further comprising a folded closure flap extending from said back wall and attachable to said front wall to close said pouch.

3. A knife sheath as claimed in claim 2, wherein the top of the pouch has a shoulder, which on the back wall merges through a neck region into the folded flap, and on the front wall meets a top straight edge angled so that when the sheath is located on the wearer's belt the top edge is substantially horizontal.

4. A knife sheath as claimed in claim 1, wherein the pouch has straight parallel sides leading to a lower portion with sides tapering to a smoothly curved convex apex.

5. A knife sheath as claimed in claim 1, wherein said tough flexible material is leather.

6. A knife sheath as claimed in claim 1 wherein said tough flexible material is ballistic nylon.

* * * * *